US009328985B2

(12) United States Patent
Malcolm

(10) Patent No.: US 9,328,985 B2
(45) Date of Patent: May 3, 2016

(54) SINGLE SHOT FIREARM

(71) Applicant: Altor Corporation, Cave Creek, AZ (US)

(72) Inventor: Alexander R. Malcolm, Cave Creek, AZ (US)

(73) Assignee: Altor Corporation, Cave Creek, AZ (US)

( * ) Notice: Subject to any disclaimer, the term of this patent is extended or adjusted under 35 U.S.C. 154(b) by 0 days.

(21) Appl. No.: 14/820,929

(22) Filed: Aug. 7, 2015

(65) Prior Publication Data

US 2016/0040950 A1 Feb. 11, 2016

Related U.S. Application Data

(60) Provisional application No. 62/035,470, filed on Aug. 10, 2014.

(51) Int. Cl.
*F41A 21/48* (2006.01)
*F41A 17/46* (2006.01)

(52) U.S. Cl.
CPC ..... *F41A 21/488* (2013.01); *F41A 17/46* (2013.01)

(58) Field of Classification Search
CPC ..... F41A 17/64; F41A 21/488; F41A 21/481; F41A 21/482; F41A 17/50
USPC ..... 42/69.01, 1.09, 1.03, 42.01, 1.16, 1.08, 42/52, 106, 51, 1.14; 89/136, 170
See application file for complete search history.

(56) References Cited

U.S. PATENT DOCUMENTS

| | | | | | |
|---|---|---|---|---|---|
| 19,328 | A | * | 2/1858 | Thomas | F41C 9/04 42/52 |
| 29,676 | A | * | 8/1860 | Davis | F41A 19/24 42/69.01 |
| 398,595 | A | * | 2/1889 | Emmens | F41A 5/16 42/1.06 |
| 628,142 | A | * | 7/1899 | Ericson | F41C 9/04 42/52 |
| 1,059,405 | A | * | 4/1913 | Sprague | F41A 3/58 42/8 |
| 1,262,060 | A | | 4/1918 | Kristofek | |
| 1,320,493 | A | * | 11/1919 | Pelc | F41C 9/04 42/52 |
| 1,608,359 | A | | 11/1926 | Biason | |
| 1,664,049 | A | | 3/1928 | Sedgley | |
| 1,681,172 | A | | 8/1928 | Cocho | |
| RE17,571 | E | * | 1/1930 | Sedgley | F41C 9/02 42/1.09 |
| 1,752,178 | A | | 3/1930 | Huguenin | |
| 1,897,992 | A | | 2/1933 | Ailes | |
| 2,195,711 | A | | 4/1940 | Hutchison | |

(Continued)

OTHER PUBLICATIONS

Design U.S. Appl. No. 29/535,557, filed Aug. 7, 2015.

(Continued)

*Primary Examiner* — Samir Abdosh
*Assistant Examiner* — John D Cooper
(74) *Attorney, Agent, or Firm* — Greenberg Traurig, LLP

(57) ABSTRACT

A single shot firearm includes a barrel and a receiver assembled together and being rotatable relative to one another between a safety position, in which a firing assembly is prevented from moving forward far enough to allow a firing pin to strike a cartridge, and a firing position, in which a notch on the barrel allows the firing assembly to the move forward far enough to strike and discharge the cartridge. The firearm includes indicia on the barrel and receiver which indicate whether the firearm is in a safety position or a firing position, depending on their relative rotational positions. The firearm further includes a trigger guide which facilitates firearm discharge by a single smooth motion of the user's finger.

14 Claims, 11 Drawing Sheets

(56) References Cited

U.S. PATENT DOCUMENTS

| | | | | | |
|---|---|---|---|---|---|
| 2,444,920 | A | | 7/1948 | Davis, Jr. et al. | |
| 2,521,083 | A | | 9/1950 | Nasello | |
| 2,634,535 | A | * | 4/1953 | Borders | F41B 15/02 42/1.08 |
| 2,741,872 | A | | 4/1956 | Sigg | |
| 2,844,902 | A | | 7/1958 | Gaylord, Jr. et al. | |
| 3,172,118 | A | * | 3/1965 | De Caro | B25C 1/143 227/10 |
| 3,241,259 | A | * | 3/1966 | McBride | F41B 15/022 42/1.08 |
| 3,385,601 | A | * | 5/1968 | Black | F41H 9/10 42/1.16 |
| 3,583,088 | A | * | 6/1971 | Buck | F41A 11/04 42/106 |
| 3,609,901 | A | * | 10/1971 | Necas | F41C 9/02 42/1.12 |
| 3,619,930 | A | * | 11/1971 | Beermann | F42C 7/12 42/1.08 |
| 3,707,794 | A | | 1/1973 | Rocha et al. | |
| 3,729,853 | A | * | 5/1973 | Critcher | F41C 9/06 124/48 |
| 4,016,666 | A | * | 4/1977 | Finn | F41C 9/00 42/1.01 |
| 4,447,977 | A | * | 5/1984 | Holmgren | F41C 9/08 42/51 |
| 4,489,515 | A | | 12/1984 | Numbers | |
| 4,490,935 | A | | 1/1985 | Plachy | |
| 4,722,148 | A | * | 2/1988 | Walker | F41A 19/23 42/40 |
| 5,062,230 | A | | 11/1991 | Braverman et al. | |
| 5,062,231 | A | | 11/1991 | Braverman et al. | |
| 5,105,569 | A | | 4/1992 | Straitiff | |
| 5,271,312 | A | | 12/1993 | Lishness et al. | |
| 5,388,361 | A | | 2/1995 | Farr | |
| 7,506,467 | B2 | * | 3/2009 | Maldonado Ferreira Lopes | F41A 19/23 42/1.16 |
| 7,739,821 | B1 | * | 6/2010 | Hamme | F41A 3/06 42/2 |
| 7,905,042 | B2 | | 3/2011 | Carmel et al. | |
| 2004/0088897 | A1 | * | 5/2004 | Braverman | F41C 9/02 42/1.09 |
| 2006/0048425 | A1 | * | 3/2006 | Frickey | F41A 19/09 42/69.01 |

OTHER PUBLICATIONS http://www.budsgunshop/catalog/product_info.php/products_id/29564.

* cited by examiner

SINGLE SHOT FIREARM

CROSS-REFERENCE TO RELATED APPLICATION

The present application is a Section 111(a) application relating to and claiming the benefit of commonly owned U.S. Provisional Patent Application No. 62/035,470, titled "SINGLE SHOT FIREARM," having a filing date of Aug. 10, 2014, which is incorporated by reference herein in its entirety.

FIELD OF THE INVENTION

The exemplary embodiments relate to firearms and, more particularly, to single shot firearms.

BACKGROUND OF THE INVENTION

Many single shot firearms have been both patented and produced. These include the well-known Derringer pistol. However, many such firearms include a large number of parts, causing them to be complicated and expensive. Some single shot firearms are designed in a manner such that they may only be operated with one hand (e.g., such that they may only be operated with the user's right hand). Additionally, safety features of such pistols may not adequately prevent them from accidental discharge while carried or when dropped. The personal nature of such firearms means that they are typically carried through daily activities in a range of contexts, making effective safety features very important.

There remains a need for single shot firearms having a reduced number of component parts, simplified construction and operation, configuration allowing ambidextrous use, as well as improved safety features for preventing accidental discharge and aesthetic design options.

SUMMARY OF THE INVENTION

In a first exemplary embodiment, a single shot firearm includes a barrel having a bore for receiving a bullet therethrough, a rear edge with a notch, and positional indicia thereon, a receiver comprising a hollow channel that is coaxial with said bore about a longitudinal axis, a travel channel extending from said hollow channel, and positional indicia on said receiver, and fitting means for assembling said barrel and said receiver together such that said barrel and said receiver are rotatable relative to one another about said longitudinal axis. The fitting means may comprise internal threads on the barrel and external threads sized and shaped to engage the internal threads on the receiver. In this first exemplary embodiment, the firearm further includes a firing assembly positioned within said hollow channel of said receiver and reciprocatingly moveable between a resting position and a firing position. The firing assembly comprises a body sized and shaped to fit and move within said hollow channel, a trigger which extends from said body and through said travel channel such that it is accessible by a user when in said resting position, and a firing pin sized and shaped to impact and discharge a cartridge. The trigger has a leading edge sized and shaped to extend beyond a forward end of said receiver and be received within said notch of said barrel when said firing assembly is in its resting position, and said leading edge of said trigger and said firing pin are sized and shaped so that when the leading edge of the trigger is prevented from extending beyond the forward edge of the receiver and into said notch on said barrel, the firing pin will also be prevented from extending far enough from the forward end of the receiver to strike and discharge a cartridge. Additionally, the firearm includes a compression spring for discharging said firearm by driving said firing assembly from said firing position toward said barrel and causing said firing pin to strike and discharge a cartridge, said spring being positioned within said hollow channel, in abutting communication with a rear end of said hollow channel and with said firing assembly. When said notch of said barrel is out of alignment with said leading edge of said trigger and the firearm cannot be discharged, then said indicia on said barrel is aligned with said indicia on said receiver in a manner indicating that the firearm is in a safety position, and when said notch of said barrel is aligned with said leading edge of said trigger, then said indicia on said barrel is aligned with said indicia on said receiver in a manner indicating that the firearm is in a firing position and can be discharged.

The positional indicia on the barrel may comprise a line and the positional indicia on the receiver may comprise an "S" indicating a safety position and an "F" indicating a firing position, such that when the notch is aligned with the leading edge of the trigger, the line on the barrel is aligned with the "F" on the receiver.

The receiver of the firearm of the first exemplary embodiment may further comprise a trigger guide sized and shaped to enable discharge of the firearm by manipulating said trigger with a single motion by a user. The trigger guide is sized and shaped to expose said trigger and allow user manipulation when said trigger is either in its resting position or intermediate its resting and firing positions, and to cover said trigger and obstruct user manipulation when said trigger is in its firing position.

The first exemplary embodiment of the firearm may further comprise fitting means for assembling the barrel and the receiver together, and the fitting means may include internal threads on the barrel and external threads on the receiver that are sized and shaped to engage the internal threads.

In a second exemplary embodiment, a single shot firearm includes a barrel having a bore for receiving a bullet therethrough, a receiver comprising a hollow channel that is coaxial with said bore about a longitudinal axis, a travel channel extending from said hollow channel, and a firing assembly positioned within said hollow channel of said receiver and reciprocatingly moveable between a resting position and a firing position, said firing assembly comprising a body sized and shaped to fit and move within said hollow channel, a trigger which extends from said body and through said travel channel such that it is accessible by a user when in said resting position, and a firing pin sized and shaped to impact and discharge a cartridge. In this second embodiment, the receiver further comprises a trigger guide sized and shaped to enable discharge of the firearm by manipulating said trigger with a single motion by a user. Moreover, the firearm further includes a compression spring for discharging said firearm by driving said firing assembly from said firing position toward said barrel and causing said firing pin to strike and discharge a cartridge, said spring being positioned within said hollow channel, in abutting communication with a rear end of said hollow channel and with said firing assembly.

The trigger guide is sized and shaped to expose said trigger and allow user manipulation when said trigger is either in its resting position or intermediate its resting and firing positions, and to cover said trigger and obstruct user manipulation when said trigger is in its firing position. In some embodiments, said trigger guide comprises a pair of sloped walls extending from either side of said travel channel, and wherein each of said pair of sloped walls has a lowest height proximate the resting position of said trigger for allowing full exposure of and access to said trigger, and a greatest height at an end opposite the lowest height proximate the firing position of said trigger and being sufficient to cover said trigger when in its firing position and obstruct user access thereto.

The second exemplary embodiment may further comprise fitting means for assembling the barrel and the receiver together, and the fitting means may include internal threads on the barrel and external threads on the receiver that are sized and shaped to engage the internal threads.

BRIEF DESCRIPTION OF FIGURES

Various embodiments will hereinafter be described in conjunction with the following figures, wherein like numerals denote like elements, and wherein.

DETAILED DESCRIPTION OF THE INVENTION

Figure 1A:
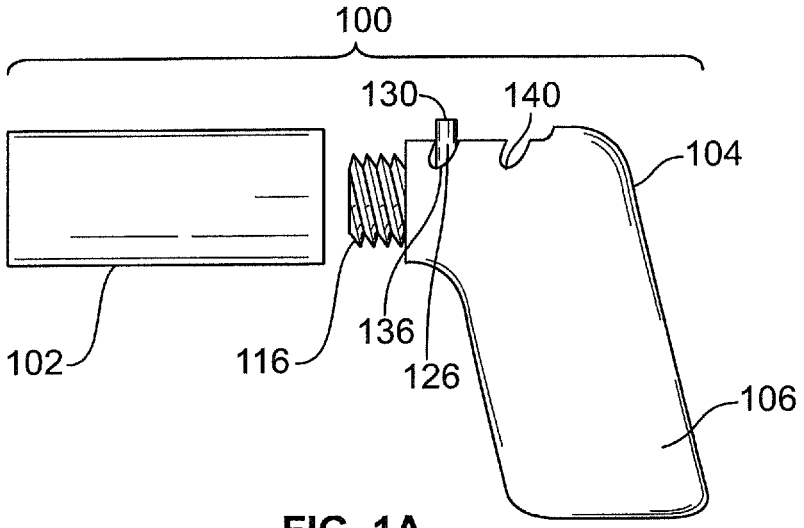
FIG. 1A is a partially disassembled side view of a first exemplary embodiment of a single shot firearm having its actuator accessible at the top of the receiver.

The exemplary embodiments described and contemplated herein relate to a single shot firearm having a small number of parts and improved safety. FIG. 1A illustrates a partially disassembled side view of a first exemplary embodiment of the single shot firearm 100 described and contemplated herein. The firearm 100 includes a barrel 102 and a receiver 104. More particularly, the receiver 104 of this first embodiment has a grip 106 that is adapted to be gripped by a user of the firearm 100 and, when the barrel 102 and receiver are assembled together, the firearm 100 has a shape generally similar to that of a typical handgun.

Figure 1B:
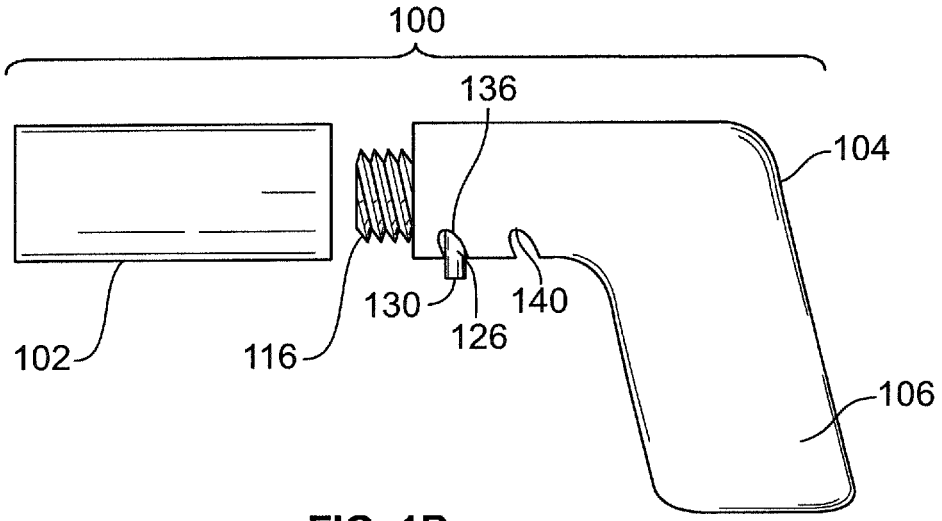
FIG. 1B is a partially disassembled side view of an alternative embodiment similar to that of FIG. 1A, but having its actuator accessible at the bottom of the receiver.

Additionally, as shown in FIG. 1, the firearm 100 includes an actuator 126 with an end 130 protruding outward from the receiver 104 through a travel channel (not shown in FIG. 1, but see the travel channel 132 shown more clearly in FIGS. 4-8). The receiver 104 further includes docking slots 136, 140 sized and shaped to receive the end 130 of the actuator 126 therein, the purpose and operation of which will be described in further detail hereinbelow. It is noted that in some embodiments, the location of these features may be different while retaining the functionality and operational advantages of the firearm 100 described and contemplated herein. For example, FIG. 1B shows a partially disassembled side view of the firearm 100 having the actuator 126 and its end 130 protruding outward from the receiver 104, but extending in a downward direction, rather than upward as in the embodiment shown in FIG. 1A. In operation, the firearm 100 having the upwardly projecting end 130 of the actuator 126 (FIG. 1A) may be comfortably operable by a user with his or her thumb, whereas the firearm 100 having the end 130 of the actuator 126 projecting downwardly from the receiver 104 (FIG. 1B) may be comfortably operable by a user with his or her forefinger.

Figure 2:
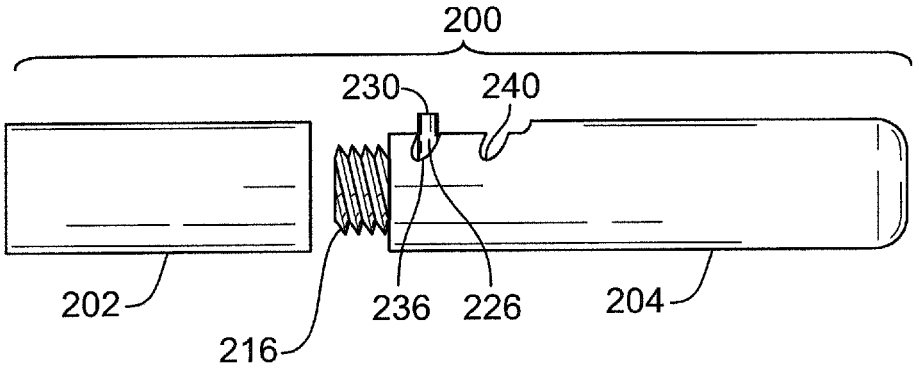
FIG. 2 is a partially disassembled side view of a second exemplary embodiment of a single shot firearm that does not have a shape resembling a handgun.

FIG. 2 illustrates a partially disassembled side view of a second exemplary single shot firearm 200. The firearm 200 of this second embodiment, includes a barrel 102 which, as shown in FIG. 2, may have a configuration the same as the barrel 102 of the first embodiment. The firearm 200 also includes a receiver 204, which differs from receiver 104 of firearm 100 in that it lacks a grip, and instead extends away from the barrel 202 in a linear direction substantially parallel to the barrel 202 after their assembly together.

Figure 3:
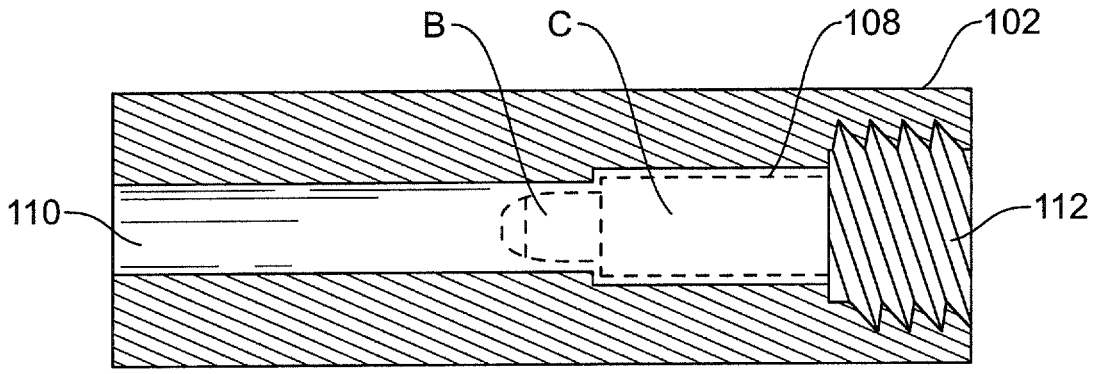
FIG. 3 is a cutaway side view of a barrel of a single shot firearm according to either of FIG. 1 or 2, with a cartridge inserted.

FIG. 3 illustrates a cutaway side view of the barrel 102. Barrel 102 includes a firing chamber 108, which is sized and shaped so as to contain cartridge C (shown in phantom in FIG. 3). Barrel 102 also includes a hollow bore 110 which is coaxial with the firing chamber 108 and sized and shaped so as to allow for the travel therethrough of bullet B which is part of the cartridge C. Barrel 102 also includes a fitting means 112 enabling the barrel 102 to be attached to receiver 104 in the assembly of firearm 100, or to the receiver 204 in the assembly of firearm 200. In some embodiments, the fitting means 112 may include an internally threaded portion (shown in FIG. 3), that cooperates with a fitting means on a receiver 104 (or 204) to be described in further detail hereinafter. In the embodiment shown in FIG. 3, for example, the fitting means 112 may include an interrupted thread (not shown per se) providing for rapid attachment and detachment of the barrel 102. Furthermore, in some embodiments, the fitting means 112 may include an interrupted thread alternating between threaded and unthreaded in 90-degree segments to provide for attachment and detachment of barrel 102 with a quarter-turn thereof. In some alternative embodiments, the fitting means 112 may include an interrupted thread alternating between threaded and unthreaded in 60-degree segments to provide for attachment and detachment of barrel 102 with a sixth-turn thereof.

Additional features of the single shot firearm will now be described in detail, particularly with respect to the receiver portion of the firearm. It is noted that, while the following description focuses on the arrangement, purposes and operation of features of the receiver 104 suitable for use with the first embodiment of the firearm 100 (see FIG. 1), it is understood that the same description and features are equally applicable to the receiver 204 suitable for use with the second embodiment of the firearm 200 (see FIG. 2), as well as other exemplary embodiments contemplated and described herein.

Figure 4:
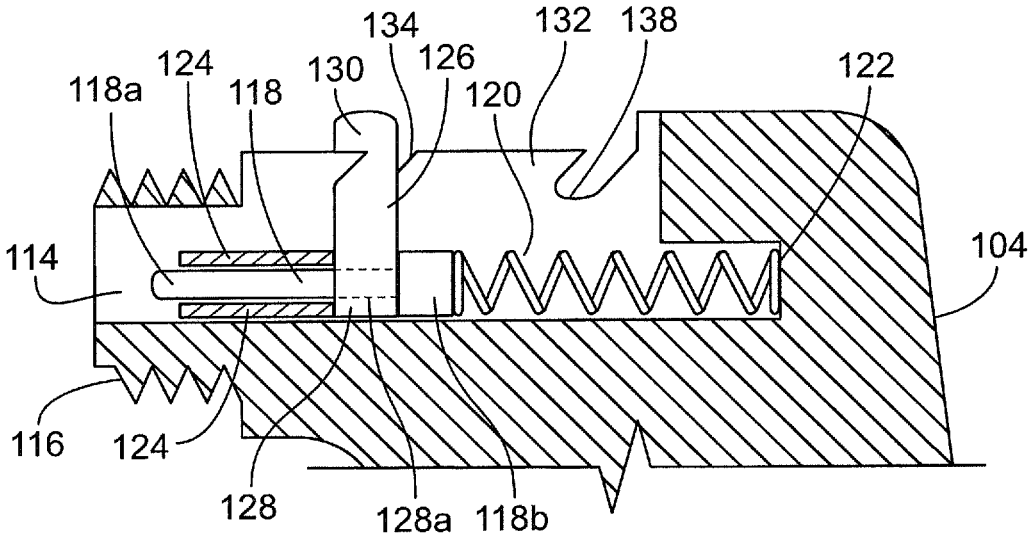
FIG. 4 is a partial cutaway side view of the receiver of the single shot firearm according to FIG. 1, with an actuator in a safety position.

Referring now to FIG. 4, a partial cut away view of the receiver 104 of the first embodiment of the single shot firearm 100 from FIG. 1 is shown having a cylindrical hollow channel 114 formed therein. The channel 114 is located so as to be coaxial with the firing chamber 108 and bore 110 when the receiver 104 is attached to the barrel 102. The receiver 104 includes a fitting means 116 adapted to engage the fitting means 112 of the barrel 102. In some embodiments, the fitting means 116 may include an externally threaded portion (as shown in FIGS. 4-8) that is complementary to the internally threaded portion of the fitting means 112 of the barrel 102. Furthermore, in some embodiments, the fitting means 116 may include an interrupted threaded portion (not shown per se) that is complementary to the fitting means 112 of the barrel 102 (e.g., alternating between threaded and unthreaded portions in 90-degree segments, or 60-degree segments, or whatever arrangement of segments correspond to those of the fitting means 112 of the barrel 102).

Continuing to refer to FIG. 4, a firing pin 118 is located within the cylindrical hollow channel 114 of the receiver 104. The firing pin 118 may be adapted to strike the cartridge C, described above with reference to FIG. 3, and thereby fire bullet B, in a manner well known and understood by those of skill in the art. In some embodiments, for example, the firing pin 118 may have an elongated post 118*a* adapted to impact the cartridge C and an enlarged head 118*b* for a purpose to be explained hereinafter. A compression spring 120 is also located within channel 114 and is positioned between firing pin 118 and the rear end 122 of the channel 114. The compression spring 120 acts to bias the firing pin 118 away from the rear end 122 of the channel 114 and toward the barrel 102, which provides impetus for the firing pin 118 to strike the cartridge C.

The channel 114 also contains a bushing 124, which surrounds the post 118*a* of the firing pin 118 to ensure that the firing pin 118 remains centered within the channel 114. To accomplish this centering, as will be readily understood by persons of ordinary skill in the art, the bushing 124 may have an outside diameter complementary to an inside diameter of the channel 114, and may have an inside diameter complementary to an outside diameter of the post 118*a* of the firing pin 118.

With continued reference to FIG. 4, the firearm 100 also includes an actuator, or trigger, 126 positioned in the receiver 104 and protruding therefrom. The actuator 126 is in butting engagement with the firing pin 118 to control movement of the firing pin 118 within the hollow channel 114 of the receiver 104. For example, in some embodiments such as that shown in FIGS. 4-7, the actuator 126 may have a first end 128 located within the hollow channel 114 and having an opening 128*a* to receive therethrough the post 118*a* of the firing pin 118. In such embodiments, the head 118*b* of the firing pin 118 may be in abutting engagement with the actuator 126 such that a force in a forward direction along the channel 114 (i.e., toward the barrel 102) exerted on the firing pin 118 by the compression spring 120 is conveyed to the actuator 126. The actuator 126 also includes a second end 130 which is opposite the first end 128 and extends from the channel 114. The actuator 126 also cooperates with the compression spring 120 to provide the firearm 100 with a safety feature that will be described in further detail hereinafter.

Figure 5:
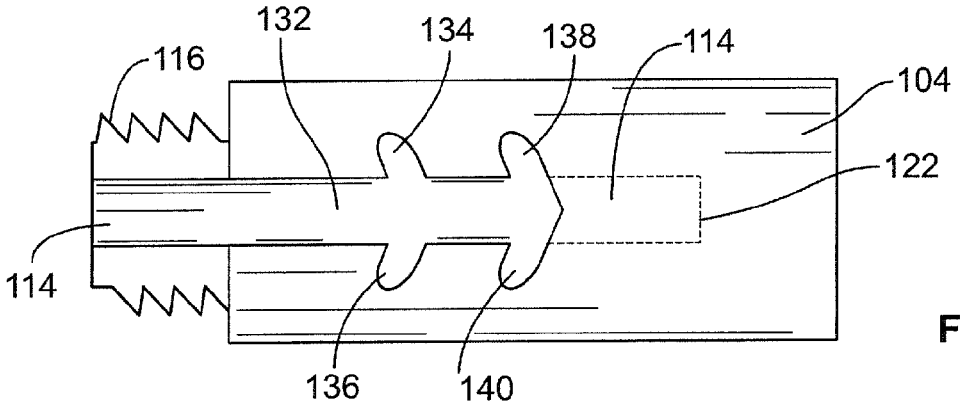
FIG. 5 is a top view of a receiver of the single shot firearm according to either of FIG. 1 or 2.

Referring now to FIG. 5, a top view is provided of the receiver 104 of the first embodiment of the firearm 100. A travel channel 132 extends upward from the cylindrical hollow channel 114 and through the top wall of the receiver 104 (see FIGS. 5-7) to allow for reciprocating movement of the actuator 126 therein. Additionally, the second end 130 of the actuator 126 extends through the travel channel 132 and is accessible by a user for moving the actuator 126 between a safety position and a firing position, as well being movable between the firing position and a discharged position, as described in detail hereinafter.

With reference still to FIG. 5, travel channel 132 includes a plurality of docking slots, such as the four docking slots 134, 136, 138, 140 shown, each of which extends from the travel channel 132. The docking slots 134, 136, 138, 140 are angled such that they extend forward (i.e., toward the barrel 102) as they extend to the side away from the travel channel 132. Each of the docking slots 134, 136, 138, 140 is sized and shaped to receive the second end 130 of the actuator 126 therein. Thus, the second end 130 of the actuator 126 can engage with any of the docking slots 134, 136, 138, 140. Two front docking slots 134, 136 are located toward a front end of the travel channel 132, i.e., toward the barrel 102. Two rear docking slots 138, 140 are located toward a rear end 122 of the travel channel 132, i.e., away from the barrel 102. Furthermore, as can be seen most clearly in FIGS. 5, 8 and 8A, two of the docking slots 134, 138 are located to the right of the travel channel 132, and the other two docking slots 136, 140 are located to the left of the travel channel 132. This arrangement of the docking slots 134, 136, 138, 140 allows the second end 130 to be reachable and manipulated by either hand of the user, and so that the firearm 100 can be operated ambidextrously, as described in further detail hereinafter.

The foregoing features and figuration of the firearm 100 also make operation and use of its safety features simple and straight-forward, as will now be described. Referring back to FIG. 4, the second end 130 of the actuator 126 is shown in a safety position wherein it is engaged with one of the front docking slots 134. When the second end 130 is engaged with either one of the front docking slots 134, 136, the firearm 100 is in a safety position. The compression spring 120 is under compression in the position illustrated in FIG. 4. As a result, the compression spring 120 urges the firing pin 118 and actuator 126 in a forward direction, thereby retaining the second end 130 of the actuator 126 in one of the front docking slots 134, 136. The force provided by the compression spring 120 to retain second end 130 of actuator 126 in one of the front docking slots 134, 136, coupled with the forward angled slant of the docking slots 134, 136 provides a safety feature that retains the actuator 126 and firing pin 118 in place, preventing the firing pin 118 from unintentionally contacting the cartridge C and thereby preventing accidental discharge of the firearm 100 during assembly or handling, or if dropped.

Figure 6:
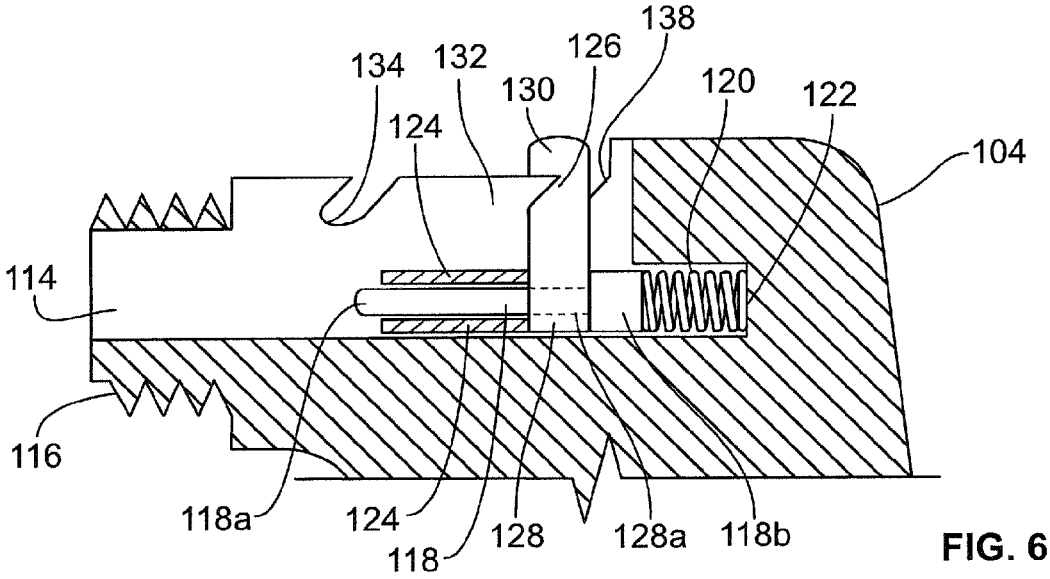
FIG. 6 is a partial cutaway side view of the receiver of the single shot firearm according to FIG. 1 with the actuator in a cocked position.

FIG. 6 shows the second end 130 of actuator 126 in a firing position wherein it is engaged with one of the rear docking slots 138. The compression spring 120 is fully compressed between the firing pin 118 and the rear end 122 of the travel channel 114. Similar to when second end 130 of actuator 126 is engaged with one of the front docking slots 134, 136 as illustrated in FIG. 4, when the actuator 126 is in the firing position illustrated in FIG. 6, the force provided by compression spring 120 acts to retain the second end 130 of the actuator 126 within either one of the rear docking slots 138, 140, thereby providing protection against accidental discharge during assembly or handling of the firearm 100, or if the firearm 100 is dropped.

To load the firearm 100, prior to assembly of the barrel 102 with the receiver 104, a cartridge C is placed into the firing chamber 108 of the barrel 102, and then the barrel 102 and receiver 104 are assembled using the fitting means 112, 116 described above. For example, referring back to FIG. 3, a cartridge C having a bullet B is shown inserted into the barrel 102 prior to assembly with the receiver 104. The second end of actuator 126 may be placed in one of the front docking slots 134, 136, as illustrated in FIG. 4, to prevent accidental discharge during assembly. The fitting means 112 of the barrel 102 is assembled to the fitting means 116 of the receiver 104 to form the firearm 100. For example, in some embodiments where the fitting means 112, 116 include threading, assembly of the firearm 100 may involve screwing the barrel 102 to the receiver 104. In further embodiments where the fitting means 112, 116 include interrupted threading, assembly of the firearm 100 may involve a partial turn (e.g., a quarter of a full rotation, or a sixth of a full rotation, etc.) of the barrel 102 with respect to the receiver 104 to accomplish attached them together.

To initiate the firing process of the firearm 100, assuming the actuator 126 is already in a safety position with the second end 130 retained in either one of the front docking slots 134, 136, the user moves the second end 130 of the actuator 126 from one of the front docking slots 134, 136 to one of the rear docking slots 138, 140. This may be referred to as a cocked or firing position, and is illustrated in FIG. 6. The firearm 100 is discharged by disengaging the second end 130 of the actuator 126 from whichever rear docking slot 138, 140 it is in, and moving it to a position within the travel channel 132, whereupon the actuator 126 is free to travel forward along travel channel 132. Then, the actuator 126 is released, whereupon the compression spring 120 drives the firing pin 118, actuator 126, and bushing 124 forward, along the travel channel 132 and hollow channel 114. As previously described, during travel of the firing pin 118, actuator 126, and bushing 124 forward toward the barrel 102 and cartridge C, the bushing 124 maintains the firing pin 118 in a central position within the hollow channel 114. When the firing pin 118 reaches the front end of the hollow channel 114 and enters the firing chamber 108 of the barrel 102, the firing pin 118 strikes the cartridge C, thereby discharging the bullet B through the hollow bore 110 of the barrel 102.

Figure 7:
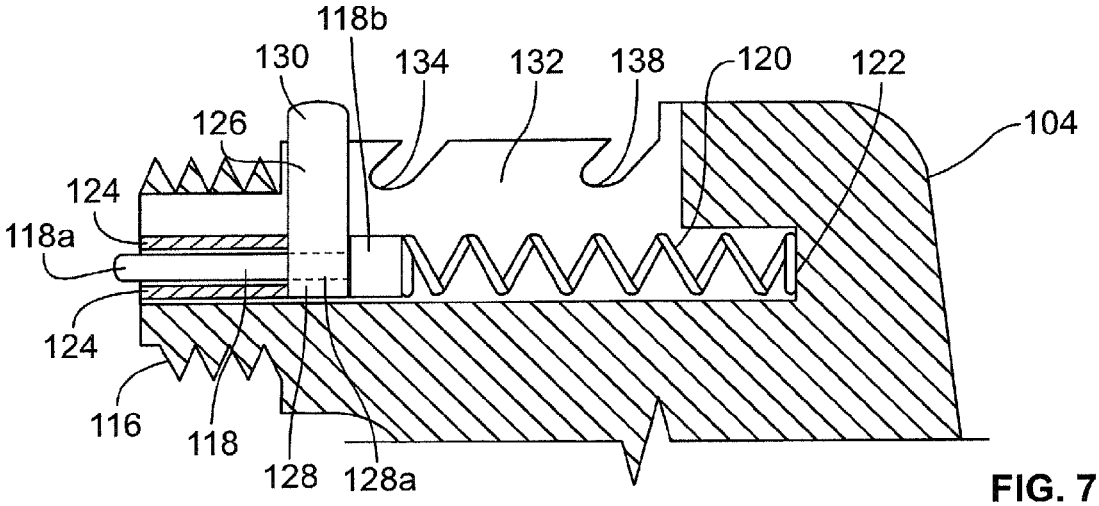
FIG. 7 is a partial cutaway side view of the receiver of the single shot firearm according to FIG. 1 with the actuator in a discharged position.

FIG. 7 shows the receiver 104 of the firearm 100 in a discharged position. Compression spring 120 is in a decompressed state within the hollow channel 114 of the receiver 104, having driven the firing pin 118, actuator 126, and bushing 124 forward such that the firing pin 118 and bushing 124 have impacted the cartridge C (not shown). It can be seen in FIG. 7 that the post 118*a* of the firing pin 118 protrudes from the hollow channel 114 of the receiver 104 which allows it to impact the cartridge C located inside the firing chamber 108 of the barrel 102 (not shown per se in FIG. 7, but see FIG. 3). Furthermore, in addition to maintaining proper axial orientation of the post 118*a* of the firing pin 118 within the hollow channel 114, it can be seen in this discharged position that, when the firearm 100 is assembled, the bushing 124 abuts against the barrel 102 thereby preventing the post 118*a* of the firing pin 118 from protruding too far and over-penetrating the cartridge C upon impact.

Figure 8:
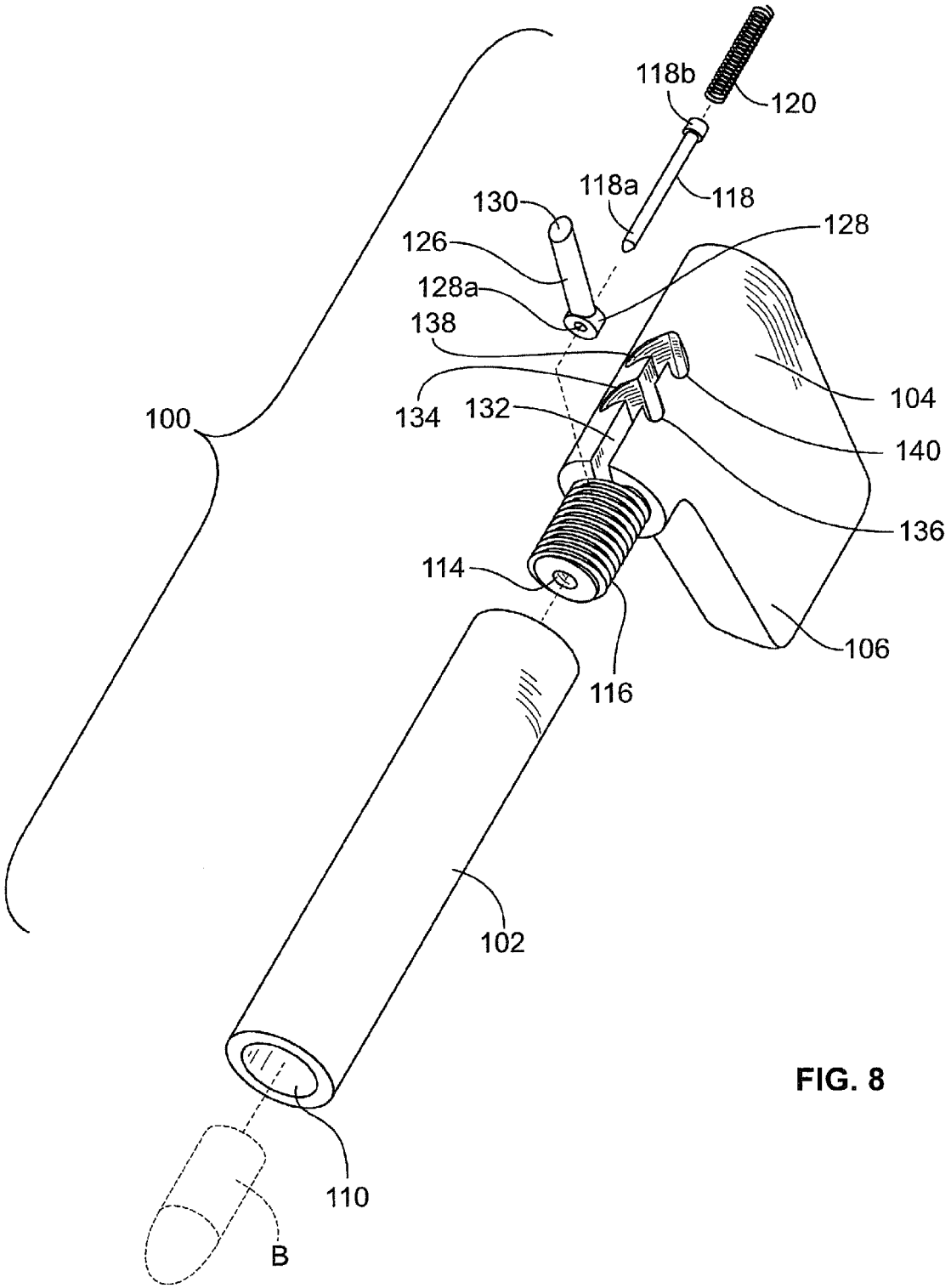
FIG. 8 is an exploded isometric view of the single shot firearm according to FIG. 1.
Figure 8A:
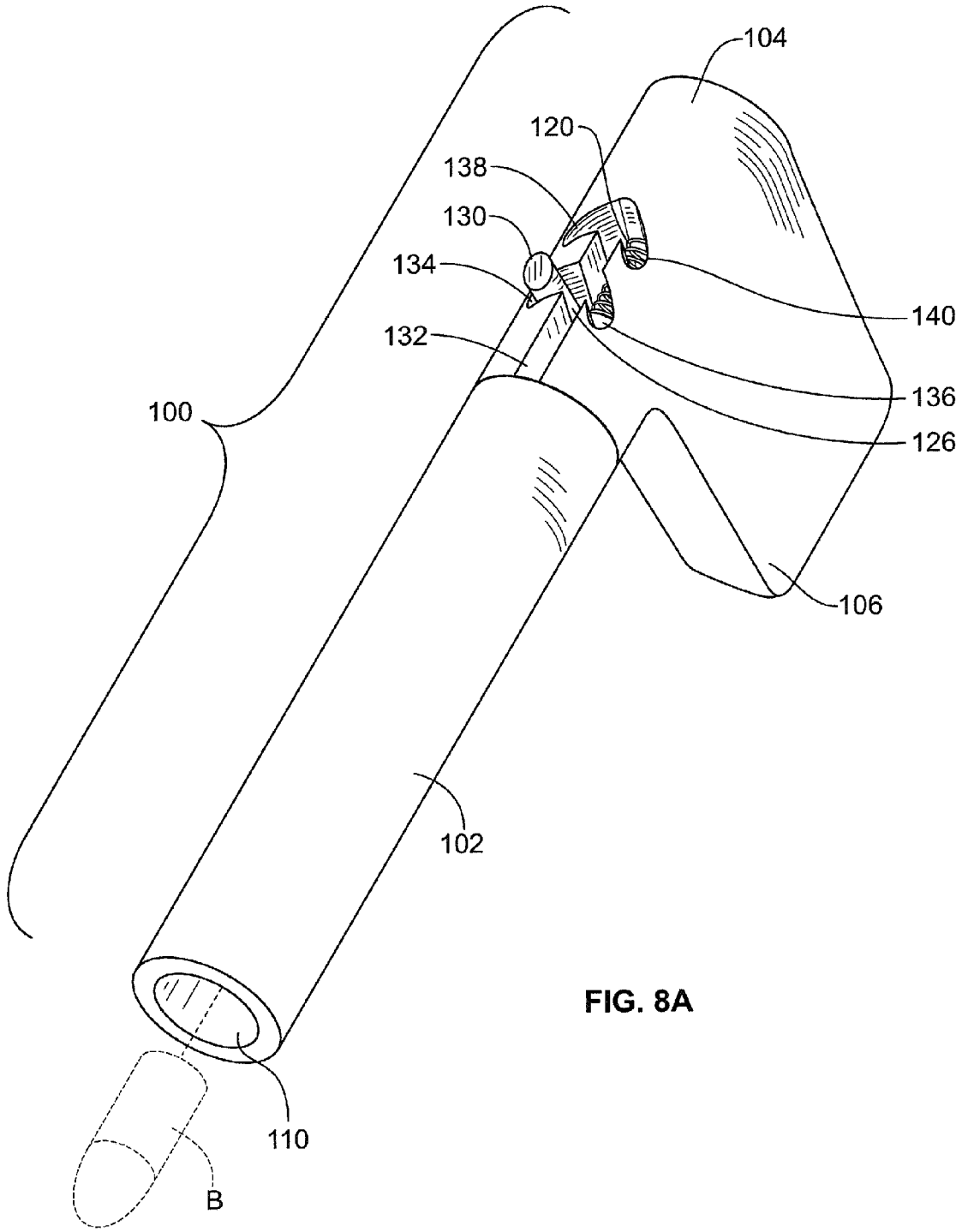
FIG. 8A is an assembled isometric view of the single shot firearm according to FIG. 1.

FIGS. 8 and 8A provide perspective views of the firearm 100 in exploded disassembled form and assembled form, respectively. The relationship and assembly of the actuator 126, firing pin 118, compression spring 120 and receiver 104 for the embodiment being described herein can be seen in FIG. 8. The compression spring 120 is placed into the hollow channel 114 and moved to the rear end 122 thereof. The post 118*a* of the firing pin 118 is inserted through the opening 128*a* of the first end 128 of the actuator 126 and then the firing pin 118 and actuator 126 together are placed in the hollow channel 114, abutting and partially compressing the compression spring 120 between the head 118*b* of the firing pin 118*b* and the rear end 122 of the hollow channel 114. For safety, the second end 130 of the actuator 126 should be inserted into one of the front docking slots 134, 136 to prevent unintended movement of the actuator 126 forward in the travel channel 132 to the discharge position. If it is desired to prepare the firearm 100 for use, then a cartridge C (not shown) is positioned in the firing chamber 108 of the barrel 102 (not shown per se, but see FIG. 3) prior to assembly. The firearm 100 is shown in FIG. 8 assembly of the barrel 102 and receiver 104. After assembly and discharge of the firearm 100, the firing pin 118 strikes the cartridge C (not shown), whereby the bullet B is projected through the hollow bore 110 of the barrel 102 and projected from the barrel 102, as is shown in FIG. 8A.

Figure 9:
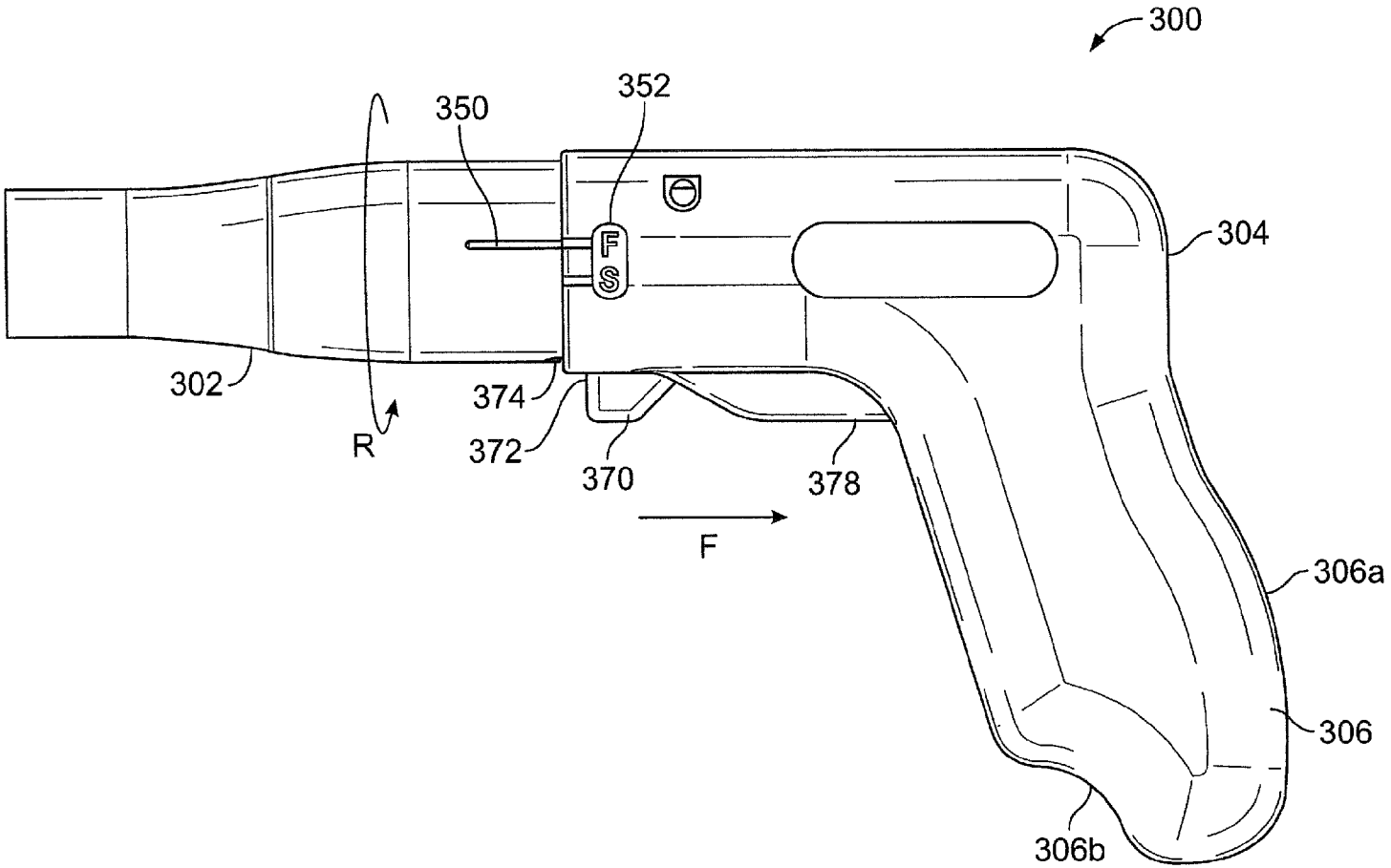
FIG. 9 is a side plan view of another examplary embodiment of a single shot firearm.
Figure 10:
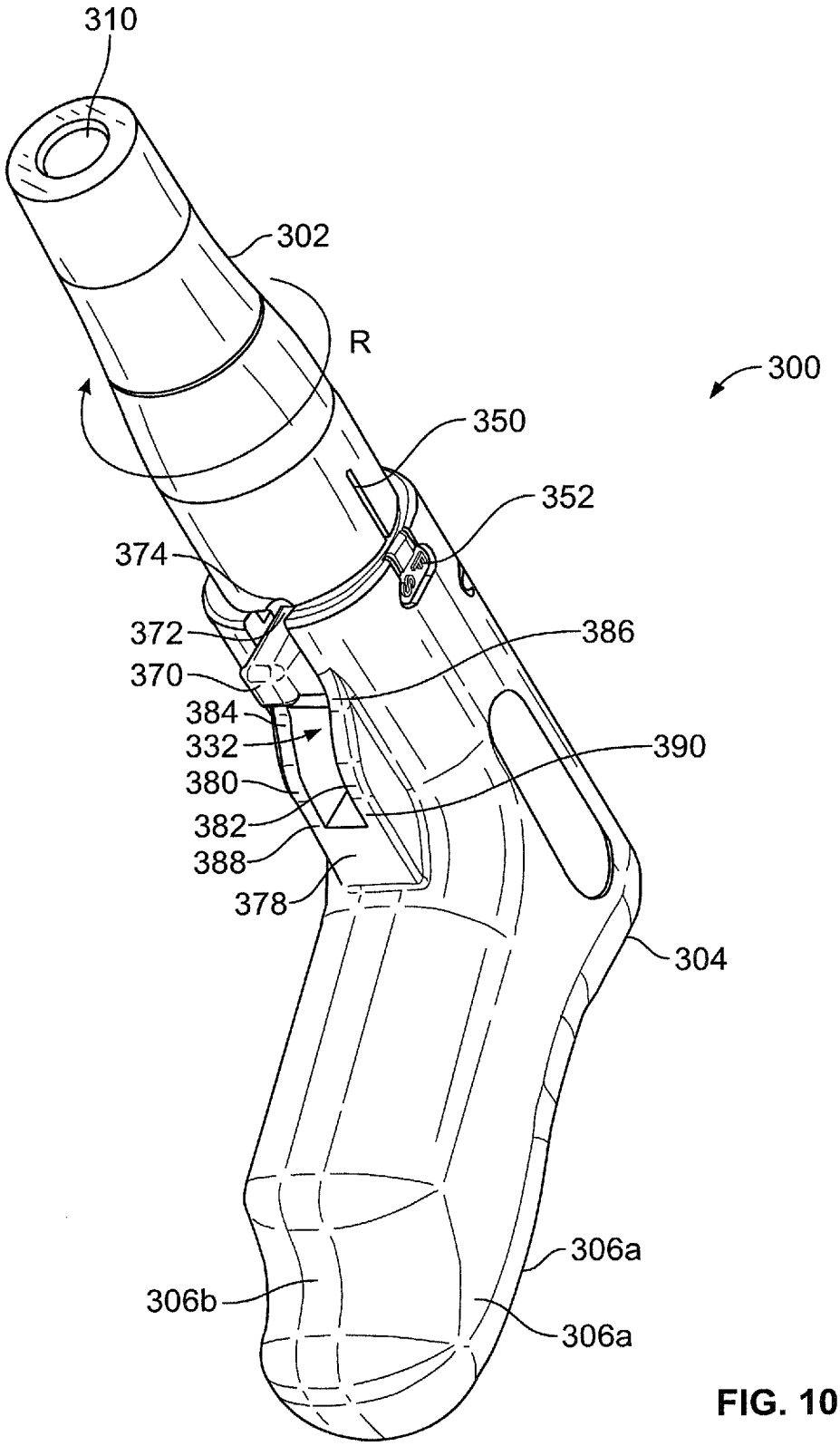
FIG. 10 is a front perspective view of the single shot firearm according to FIG. 9.

Another exemplary embodiment of the firearm 300 will now be described with reference to FIGS. 9-15. More particularly, FIG. 9 shows a side view and FIG. 10 shows a front perspective view of an assembled single shot firearm 300. Like previous embodiments, this embodiment of the firearm 300 has a barrel 302 and a receiver 304. The receiver 304 has a handle portion 306 sized and shaped for holding and manipulating the firearm 300 with a user's hand, i.e., either the left or right hand. In some embodiments, the handle 306 may include convex or concave contours, such as the contours 306*a*, 306*b* shown in FIGS. 9 and 10, which are sized and shaped to accommodate the heel or one or more fingers of a user's hand.

Additionally, both the barrel 302 and the receiver 304 have positional indicia 350, 352, respectively, for indicating whether the firearm 300 is in a safety position or a firing position, depending on the orientation of the barrel 302 and receiver 304 relative to one another. The indicia 350, 352 may be any markings, letters, numbers, symbols, or the like, that are capable of providing information to users regarding the relative orientation of the barrel 302 and receiver 304. For example, in the embodiment shown in FIGS. 9-15, the barrel 302 includes a simple line 350 formed by a groove in the exterior surface of the barrel 302 and located proximate the receiver 304 when the two are assembled together. Furthermore, the indicia 352 on the receiver 304 may, for example, include an "S" to indicate a safety position and an "F" to indicate a firing position. Either the "S" or the "F" will align with the line 350 on the barrel 302, depending on the orientation of the barrel 302 and receiver 304 when assembled and rotated in relation to one another, as will be described hereinafter in connection with the safety feature of the firearm 300. The indicia 350, 352 on the barrel 302 and receiver 304 are shown in FIGS. 9-12 on the left side of the firearm 300. Although not shown per se in the figures, it is noted that additional indicia may also be provided on the right side of the firearm 300 to facilitate ambidextrous use of the firearm 300.

Figure 11:
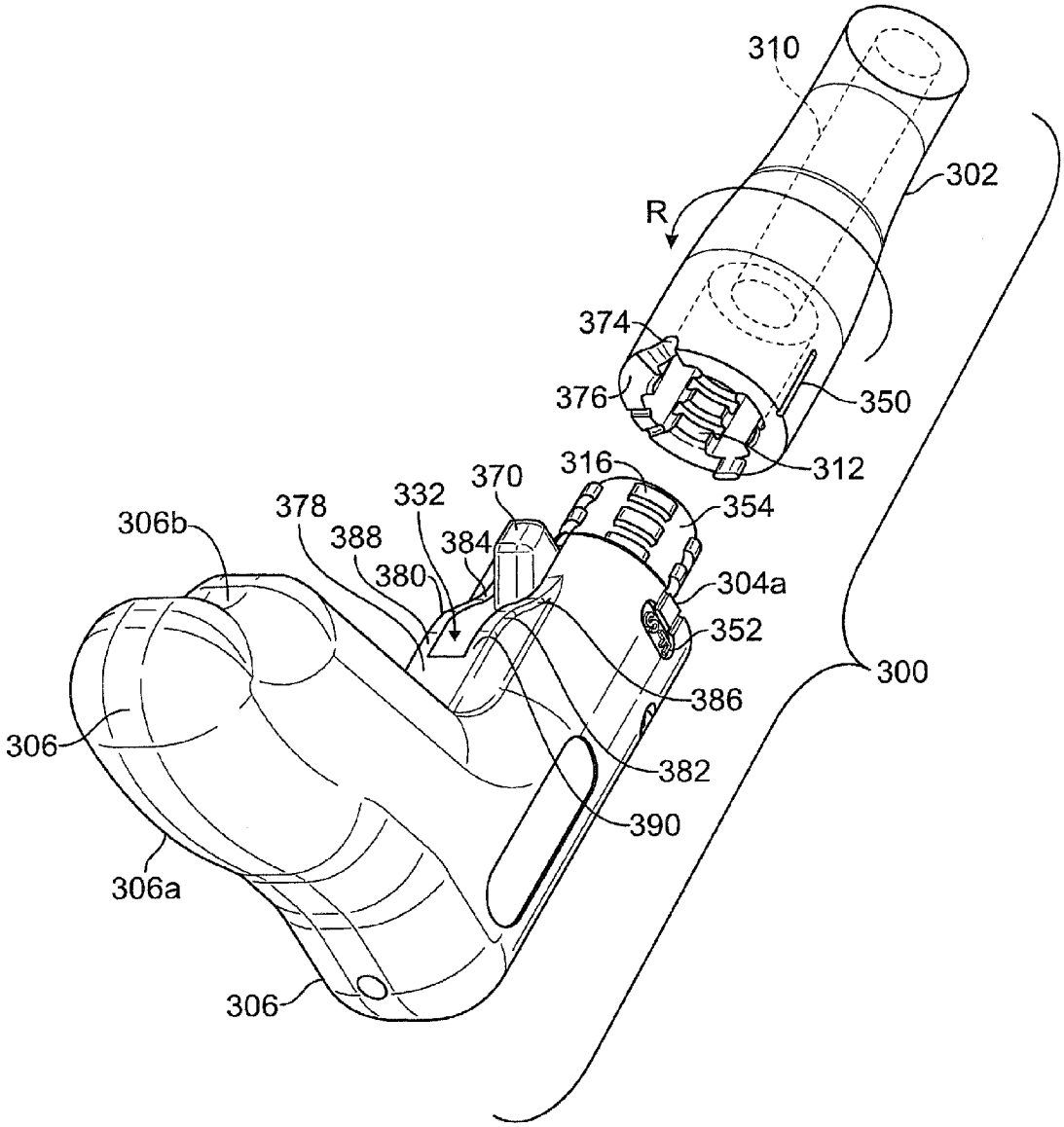
FIG. 11 is a rear perspective view of a partially disassembled single shot firearm according to FIG. 10.
Figure 12:
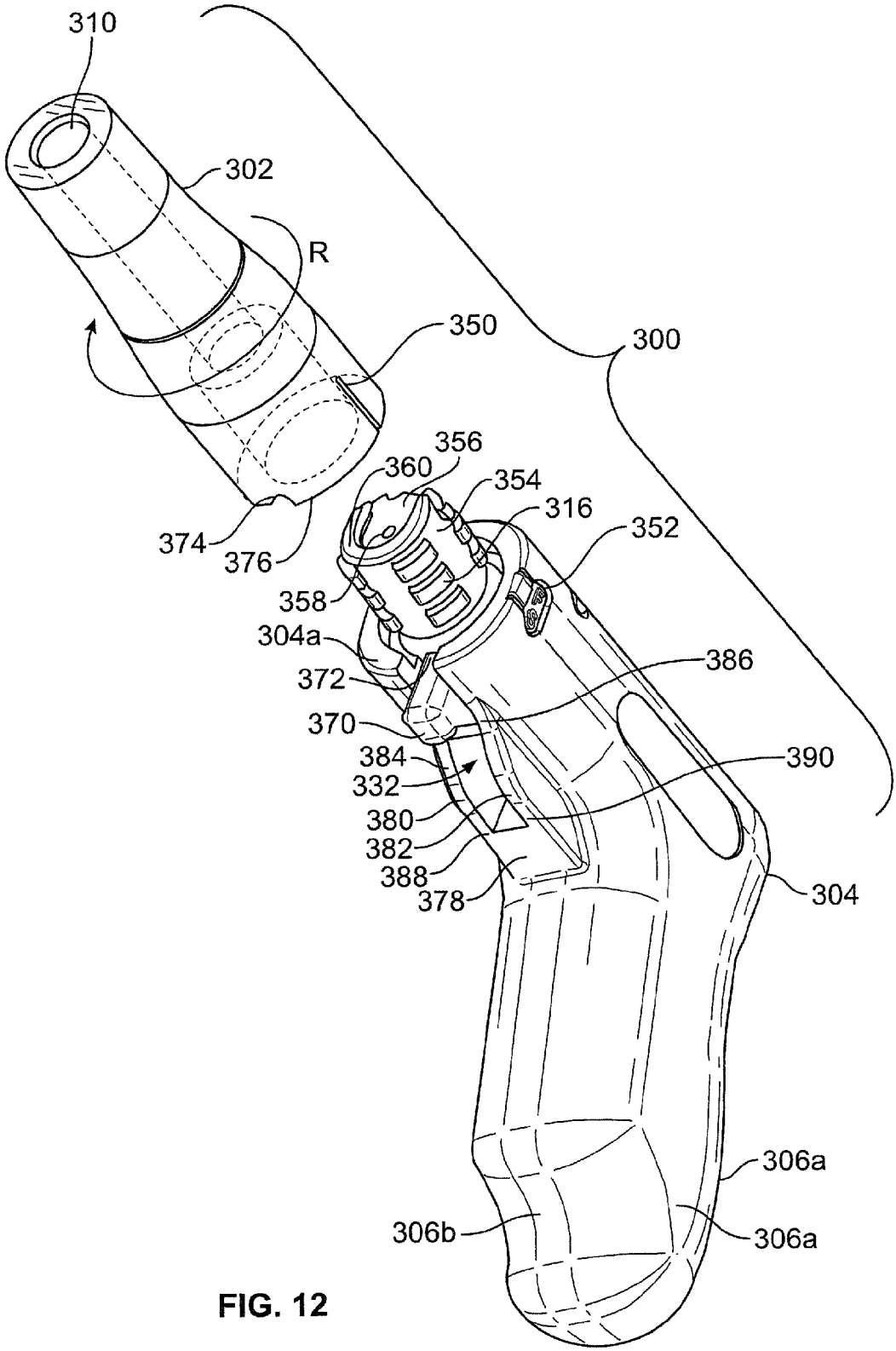
FIG. 12 is a front perspective view of a partially disassembled single shot firearm according to FIGS. 10 and 11.

With reference now to the disassembled perspective views of the firearm 300 provided in FIGS. 11 and 12, the barrel 302 further includes a bore 310 (shown in phantom only) for travel therethrough of a bullet (not shown). The barrel 302 also includes fitting means 312 for securely assembling the barrel 302 and receiver 304 together. The fitting means 312 may, for example, include an internally threaded portion 312, such as has been described above in detail in connection with other embodiments of the single shot firearm 100, 200 contemplated herein. In some embodiments, the internally threaded portion 312 may comprise interrupted threads, as shown in FIG. 11 and also described previously in connection with other embodiments of the firearm 100, 200.

As also shown in FIGS. 11 and 12, the firearm 300 further includes a cylindrical breech plug 354 which fits onto the forward end 304*a* of the receiver 304 and extends forwardly therefrom (i.e., toward the barrel 302). The breech plug 354 is sized and shaped to fit into the barrel 302 and includes fitting means 316 adapted to engage the fitting means 312 of the barrel 302, when the barrel 302 and receiver 304 are assembled together. For example, in some embodiments where the fitting means 312 of the barrel 302 comprises an internal threaded portion 312, the fitting means 316 of the breech plug 354 may include an externally threaded portion 316 (as shown in both of FIGS. 11 and 12) that is complementary to the internally threaded portion 312 of the barrel 302. More particularly, in some embodiments, the fitting means 316 may include an interrupted threaded portion, as shown in FIGS. 11 and 12, that is complementary to an interrupted threaded portion 312 of the barrel 102, as described above in connection with other embodiments of the forearm 100, 200 contemplated herein.

The cylindrical breech plug 354 is substantially hollow and also has a planar face 356 positioned remotely from the receiver 304 and having a centrally located opening 358 sized and shaped to receive a firing pin therethrough, as described in further detail below. A cartridge retaining means 360, such as the raised U-shaped ridge shown in FIG. 12, is provided on the planar face 356 of the breech plug 354 for centering and securely retaining a cartridge (not shown) abutting against the planar face 356. As will be familiar to by persons of ordinary skill in the art, a typical cartridge (see, e.g., cartridge C in FIG. 3) has a rear charge section and a bullet (see, e.g., bullet B in FIG. 3) that is separated and projected away from the charge section upon striking and ignition of the charge section of the cartridge. It is noted that, as will also be understood by persons of ordinary skill, the cartridge retaining means 360 should be sized and shaped to securely retain the charge section of the cartridge after ignition and projection of the bullet to facilitate disassembly of the firearm 300, recovery of the spent charge section and reloading a new cartridge into the firearm 300.

Figure 13:
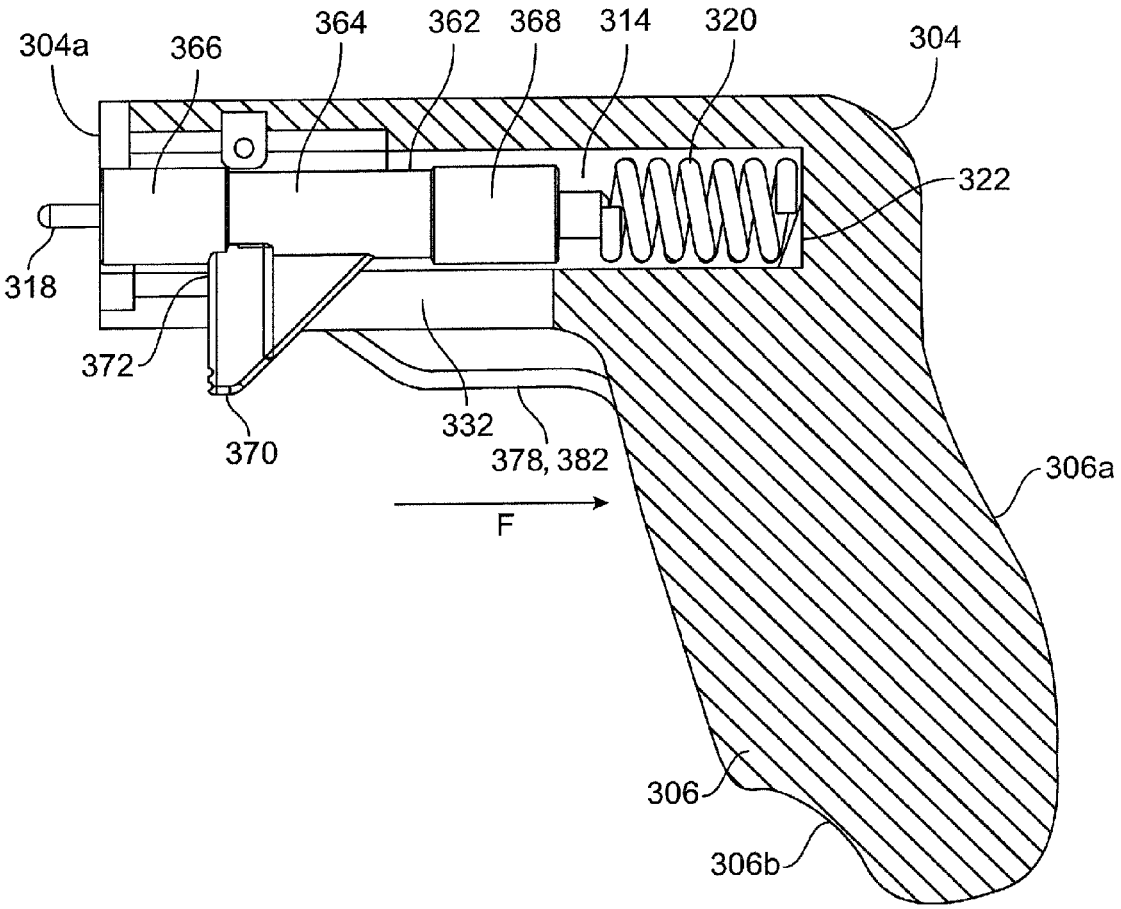
FIG. 13 is a side cross sectional view of the receiver of the single shot firearm according to FIGS. 9-12, showing the position of the firing assembly therein.
Figure 14:
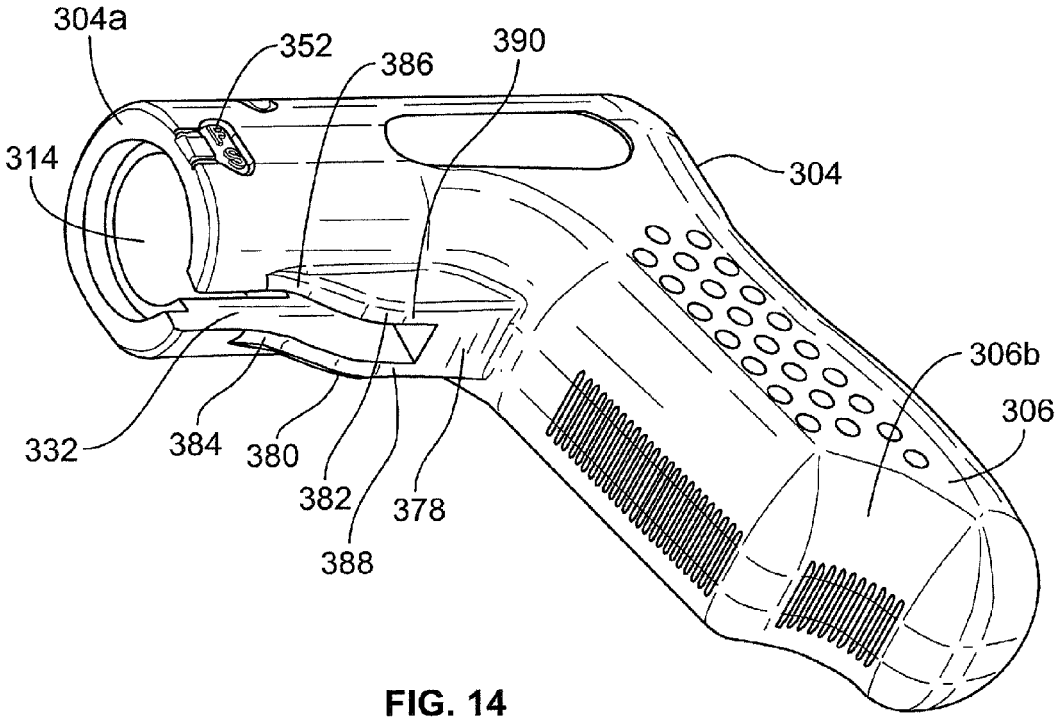
FIG. 14 is a front perspective view of the receiver of the single shot firearm according to FIGS. 9-13.
Figure 15:
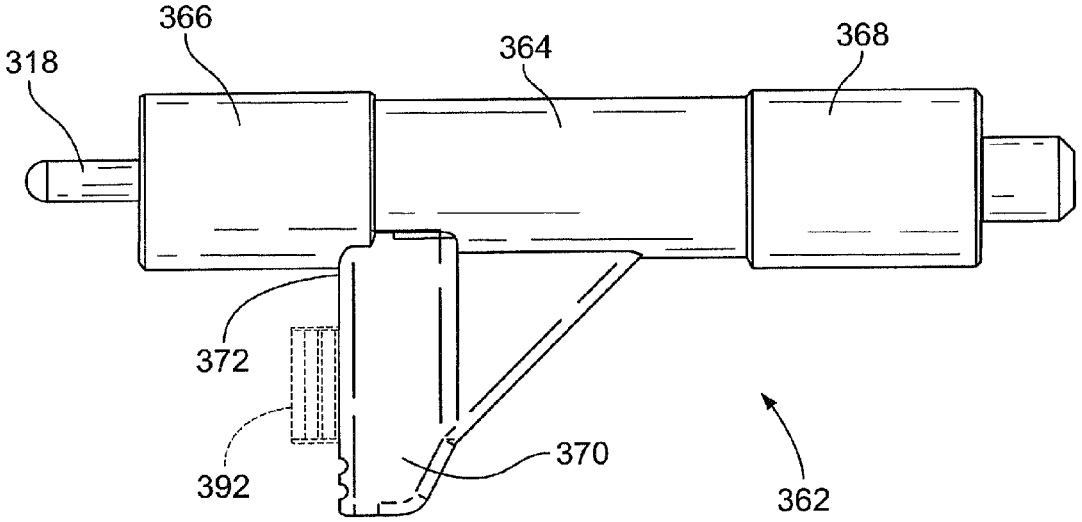
FIG. 15 is a side view of the firing assembly of the single shot firearm according to FIGS. 9-13.

With reference now to FIGS. 13 and 14, the receiver 304 has a cylindrical hollow channel 314 for containing a firing assembly 362 and a compression spring 320 therein (see FIGS. 13 and 15). When the barrel 302 and receiver 304 are assembled with one another, the hollow channel 314 is coaxial with the bore 310 of the barrel 302. The firing assembly 362 is reciprocatingly moveable within the hollow channel 314 of the receiver 304, between a resting position (shown in FIGS. 9-13) and a firing position (not shown per se, but see the description provided hereinafter and, e.g., FIG. 6).

FIG. 13 provides a cross sectional side view of the receiver 304 having the compression spring 320 and firing assembly 362 arranged within the hollow channel 314. As shown, the compression spring 320 is positioned against the rear end 322 of the hollow channel 314, while the firing assembly 362 is positioned proximate the forward end 304*a* of the receiver 304 and abutting against the compression spring 320. In this arrangement, the compression spring 320 is not compressed but does urge the firing assembly 362 toward the forward end 304*a* of the receiver 304. This is the resting position of the firing assembly 362. Although not shown per se in the figures, but as persons of ordinary skill will readily understand, the firing position of the firing assembly 362 is where the firing assembly 362 is in a position proximate the rear end 322 of the hollow channel 314 and in which position the compression spring 320 is compressed.

More particularly, with reference specifically to FIGS. 13 and 15, the firing assembly 362 includes a body 364 sized and shaped to fit in the hollow channel 304 and allow the aforesaid reciprocating movement. For example, in the embodiment shown in FIGS. 13 and 15, the body 364 of the firing assembly 362 has a front bushing 366 and a rear bushing 368 each having an external diameter commensurate with the internal diameter of the hollow channel 314.

The firing assembly 362 includes a firing pin 318 that extends forward (i.e., toward the barrel 302 of the firearm 300 when assembled) from the body 364 and, more particularly, forward from the front bushing 366 as shown in FIGS. 13 and 15. When the barrel 302 and receiver 304 of the firearm 300 are assembled together, and the firing assembly 362 is in the resting position shown in the figures, at least a portion of the body 364 of the firing assembly 362 (e.g., the front bushing 366 seen in FIGS. 13 and 15) can extend forward and be received into the hollow breech plug 354, which in turn allows the firing pin 318 to extend through the centrally located opening 358 of the planar face 356 of the breech plug 354. In this position, the firing pin 318 may contact a cartridge (not shown) retained in the cartridge retaining means 360 of the breech plug 354, but will not strike the cartridge with sufficient force to ignite the cartridge and accidentally discharge the firearm 300.

The firing assembly 362 also includes an actuator, or trigger 370, which extends downward from the body 364. The receiver 304 has an open travel channel 332 extending along a portion of the hollow channel 314 to receive the trigger 370 therethrough and allow the trigger 370 to extend outside the receiver 304 where it is accessible by the user. More particularly, when the barrel 302 and receiver 304 are assembled together and the firing assembly 362 is in the resting position, the trigger 370 extends out of the hollow channel 314, through the travel channel 332 and outside the receiver 304 (see any of FIGS. 9-13). In this resting position, a user can move the trigger 370, and consequently the entire firing assembly 362, with his or her finger toward the firing position (i.e., in the direction of the arrow F in FIGS. 9 and 13), whereupon the compression spring 320 will be compressed against the rear end 322 of the hollow channel 314 in the receiver 304. In some embodiments, the trigger 370 may include a finger grip 392, as shown in phantom in FIG. 15, to provide enhanced manipulation of the trigger 370.

As shown in the embodiment of FIGS. 9-15, in some embodiments of the firearm 300, the firing assembly 362 may be a single unitary component having all the aforesaid features formed integrally together in a manner known to persons having ordinary skill in the relevant art. Of course, one or more of the above described features of the firing assembly 362 may be made independently of one another and then assembled together to form a unitary firing assembly 362, however, it is believed that efficiency and cost of the firearm are improved by making and using as few parts as possible to provide a suitable firing assembly 362 in accordance with the embodiment of the firearm 300 described and contemplated herein. For example, a useful aspect of an embodiment of the firearm 300 having a unitary firing assembly 362 is that the entire firing assembly 362 moves and reciprocates within the hollow channel 314 together, thereby reducing frictional forces and the reducing the potential for malfunction of separately moving parts. Additionally, it is believed that assembly and operation of the firearm 300 is simplified for the use when the firing assembly 362 is provided as a single unity component as shown in FIGS. 13 and 15.

The safety feature of this embodiment of the single shot firearm 300 will now be described. It is noted that the trigger 370 has a leading edge 372 proximate the body 364 of the firing assembly 362 and the firing assembly 362 is sized and shaped so that, in order for the firing pin 318 to sufficiently impact and discharge the cartridge when driven forward by the compression spring 320, the leading edge 372 of the trigger 370 must also extend beyond the forward end 304*a* of the receiver 304. In other words, the firing assembly 362 is sized and shaped so that if the leading edge 372 of the trigger 370 is prevented from extending beyond the forward end 304*a* of the receiver 304, such as for example, by the rear edge 376 of the barrel 302, then the firing pin 318 will also be prevented from striking the cartridge (not shown) with sufficient force to cause discharge.

With particular reference now to FIGS. 10-12, a notch 374 is provided on the rear edge 376 of the barrel 302. The notch 374 is sized and shaped to receive therein the leading edge 372 of the trigger 370, when the leading edge 372 protrudes beyond the forward end 304*a* of the receiver 304 and the notch 374 and leading edge 372 are aligned with one another. In some embodiments, the leading edge 372 of the trigger 370 may be of narrower width than the main body of the trigger 370 so as to facilitate their mating and not require a notch 374 of impractical width. When the notch 374 and leading edge 372 of the trigger 370 are aligned, which can be accomplished by rotating the barrel 302 and receiver 304 relative to one another, the firearm 300 is in a firing position and may be discharge since the firing pin 318 will also be permitted to extend far enough from the forward edge 304*a* of the receiver 304 to strike and discharge a cartridge (not shown). Conversely, when the when the notch 374 and leading edge 372 of the trigger 370 are out of alignment with one another, the firearm 300 is in a safety position and cannot be discharge since the firing pin 318 will be prevented from extending far enough from the forward edge 304*a* of the receiver 304 to strike and discharge a cartridge (not shown).

Of course, when the barrel 302 and receiver 304 are rotated relative to one another, thus changing the position of the notch 374 relative to the receiver 304 and leading edge 372 of the trigger 370, then the alignment of the positional indicia 350, 352 described above will also change relative to one another. The notch 374 is positioned on the rear edge 376 of the barrel 302 at a distance from the positional indicia 350 thereon so that when the notch 374 is aligned with the leading edge 372 of the trigger 370 in the receiver 304, then the positional indicia 350 on the bar the position of the notch 374 relative to the receiver 304*rel* 302 is also aligned with the indicia 352 on the receiver 304 that indicates a firing position, e.g., with the "F" on the receiver 304 in FIGS. 9-12 and 14. Similarly, when the barrel 302 is rotated relative to the receiver 304, such as in the direction indicated by the arrow R in FIGS. 9-11, the notch 374 will no longer align with the leading edge 372 of the trigger 370, which will result in the leading edge 372 of the trigger 370 impacting the rear edge 376 of the barrel 302 and halting before the firing pin 318 can impact and discharge the cartridge. When the notch 374 is out of alignment with the leading edge 372 of the trigger 370, the positional indicia 350 on the barrel 302 will be aligned with the positional indicia 352 on the receiver 304 that indicates the firearm 300 is in a safety position, e.g., with the "S" on the receiver 304 in FIGS. 9-12 and 14. As will be recognized by persons of ordinary skill in the art, the notch 374 should only be as deep as necessary to permit the firing pin 318 to strike the cartridge (not shown) with sufficient force to ignite and discharge the cartridge without over penetration. For example, the notch 374 may be from about 0.005 inch to about 0.025 inch, such as for example, from about 0.005 inch to about 0.020 inch, or from about 0.010 inch to about 0.020 inch, or even from about 0.015 inch to about 0.020 inch, with the understanding that the endpoints of the foregoing ranges are combinable and interchangeable.

With reference to FIGS. 9-14, it can be seen that the receiver 304 has a trigger guide 378 that is sized and shaped to expose the trigger 370 and allow user manipulation when the trigger 370 is in its resting position and intermediate its resting and firing positions, and to cover the trigger 370 and obstruct user manipulation when the trigger reaches its firing position (see FIG. 9 in phantom). This allows the user to discharge the firearm 300 with a single smooth motion of the user's finger on the trigger 370, as described below. For example, in some exemplary embodiments such as shown in FIGS. 9-14, the trigger guide 378 may be formed by pair of sloped walls 380, 382 which are substantially symmetrical with one another. Each sloped wall 380, 382 has a lowest height 384, 386, respectively, proximate the trigger's 370 resting position (proximate the forward end 304*a* of the receiver 304), to allow for full exposure of and access to the trigger 370 by a user, and a greatest height 388, 390, respectively, at an end opposite the lowest height 384, 386 and being sufficient to cover the trigger 370 when it has reached its firing position (i.e., whereupon the compression spring 320 is at maximum compression).

In operation, to discharge the firearm 300, the user's finger rests on and slides along the trigger guide 378, while moving the trigger 370 from its resting position toward the firing position. When the trigger 370 reaches the portion of the trigger guide 378 where the walls 380, 382 have the greatest height 388, 390, respectively, the trigger 370 is covered and user access thereto obstructed, so that the user no longer controls the trigger 370. At the time when the user's finger no longer controls the trigger 370, the compression spring 320 which is at maximum compression projects the firing assembly 362 forward so that the firing pin 318 impacts and ignites the charge section of a cartridge (not shown), whereby the bullet (not shown) is projected through the bore 310 of the barrel 302 of the firearm 300. After discharge, the firing assembly 362 and trigger 370 have returned to, and remain in, the resting position proximate the forward end 304*a* of the receiver 304. Thus, operation of this embodiment of the single shot firearm 300 is simplified whereby discharge of the firearm is quickly and safely accomplished by a single smooth motion with a user's finger. Without the trigger guide 378, to discharge the firearm 300, the user would have to move the trigger 370 from its resting position to its firing position, and then actively remove his or her finger from the trigger 370 to release it and allow the trigger assembly 362 to be projected forward by the compression spring (320) with the firing pin 318 then striking the cartridge. The trigger guide 378 provides for passive release of the trigger 370 from the user's finger and eliminates the need for the user to actively remove his or her finger from the trigger 370.

It should be understood that the embodiments described herein are merely exemplary in nature and that a person skilled in the art may make many variations and modifications thereto without departing from the scope of the present invention. All such variations and modifications, including those discussed above, are intended to be included within the scope of the invention.

What is claimed is:

1. A single shot firearm, comprising:

a barrel having a bore for receiving a bullet therethrough, a rear edge with a notch, and positional indicia thereon;

a receiver comprising a hollow channel that is coaxial with said bore about a longitudinal axis, a travel channel extending from said hollow channel, and positional indicia on said receiver;

fitting means for assembling said barrel and said receiver together such that said barrel and said receiver are rotatable relative to one another about said longitudinal axis;

a firing assembly positioned within said hollow channel of said receiver and reciprocatingly moveable between a resting position and a firing position, said firing assembly comprising a body sized and shaped to fit and move within said hollow channel, a trigger which extends from said body and through said travel channel such that it is accessible by a user when in said resting position, said trigger having a leading edge sized and shaped to extend beyond a forward end of said receiver and be received within said notch of said barrel when said firing assembly is in its resting position; and a firing pin sized and shaped to impact and discharge a cartridge; wherein said leading edge of said trigger and said firing pin are sized and shaped so that when the leading edge of the trigger is prevented from extending beyond the forward edge of the receiver and into said notch on said barrel, the firing pin will also be prevented from extending far enough from the forward end of the receiver to strike and discharge a cartridge;

a compression spring for discharging said firearm by driving said firing assembly from said firing position toward said barrel and causing said firing pin to strike and discharge a cartridge, said spring being positioned within said hollow channel, in abutting communication with a rear end of said hollow channel and with said firing assembly;

wherein, when said notch of said barrel is out of alignment with said leading edge of said trigger and the firearm cannot be discharged, then said indicia on said barrel is aligned with said indicia on said receiver in a manner indicating that the firearm is in a safety position, and when said notch of said barrel is aligned with said leading edge of said trigger, then said indicia on said barrel is aligned with said indicia on said receiver in a manner indicating that the firearm is in a firing position and can be discharged.

2. The firearm of claim 1, wherein said positional indicia on said barrel comprises a line and said positional indicia on said receiver comprises an "S" indicating a safety position and an "F" indicating a firing position, and wherein when said notch is aligned with said leading edge of said trigger, said line on said barrel is aligned with said "F" on said receiver.

3. The firearm of claim 1, wherein said fitting means comprises internal threads on said barrel and external threads on said receiver that are sized and shaped to engage said internal threads.

4. The firearm of claim 3, wherein a portion of said bore of said barrel proximate to said rear edge of said barrel comprises said internal threads and said external threads are positioned proximate said forward end of said receiver.

5. The firearm of claim 4, wherein said firearm further comprises a breech plug sized and shaped to fit onto said forward end of said receiver and said breech plug comprises said external threads.

6. The firearm of claim 1, wherein said receiver further comprises a trigger guide sized and shaped to enable discharge of the firearm by manipulating said trigger with a single motion by a user.

7. The firearm of claim 6, wherein said trigger guide is sized and shaped to expose said trigger and allow user manipulation when said trigger is either in its resting position or intermediate its resting and firing positions, and to cover said trigger and obstruct user manipulation when said trigger is in its firing position.

8. The firearm of claim 7, wherein said trigger guide comprises a pair of sloped walls extending from either side of said travel channel, and wherein each of said pair of sloped walls has a lowest height proximate the resting position of said trigger for allowing full exposure of and access to said trigger, and a greatest height at an end opposite the lowest height proximate the firing position of said trigger and being sufficient to cover said trigger when in its firing position and obstruct user access thereto.

9. The firearm of claim 1, further comprising cartridge retaining means for retaining a cartridge in a position in said firearm aligned with said longitudinal axis so that said firing pin will strike and discharge the cartridge.

10. A single shot firearm, comprising:

a barrel having a bore for receiving a bullet therethrough;

a receiver comprising a hollow channel that is coaxial with said bore about a longitudinal axis, a travel channel extending from said hollow channel;

a firing assembly positioned within said hollow channel of said receiver and reciprocatingly moveable between a resting position and a firing position, said firing assembly comprising a body sized and shaped to fit and move within said hollow channel, a trigger which extends from said body and through said travel channel such that it is accessible by a user when in said resting position, and a firing pin sized and shaped to impact and discharge a cartridge;

a compression spring for discharging said firearm by driving said firing assembly from said firing position toward said barrel and causing said firing pin to strike and discharge a cartridge, said spring being positioned within said hollow channel, in abutting communication with a rear end of said hollow channel and with said firing assembly;

wherein said receiver further comprises a trigger guide sized and shaped to expose said trigger and to enable discharge of the firearm by a user who manipulates said trigger with a single motion when said trigger is either in its resting position or intermediate its resting and firing positions, said trigger guide comprising a pair of sloped walls extending from either side of said travel channel, each of said pair of sloped walls having a lowest height proximate the resting position of said trigger for allowing full exposure of and access to said trigger, and a greatest height at an end opposite the lowest height proximate the firing position of said trigger and being sufficient to cover said trigger when in its firing position and obstruct user access thereto.

11. The firearm of claim 10, further comprising fitting means for assembling said barrel and said receiver together.

12. The firearm of claim 11, wherein said fitting means comprises internal threads on said barrel and external threads on said receiver that are sized and shaped to engage said internal threads.

13. The firearm of claim 12, wherein a portion of said bore of said barrel proximate to a rear edge of said barrel comprises said internal threads and said external threads are positioned proximate a forward end of said receiver.

14. The firearm of claim 13, wherein said firearm further comprises a breech plug sized and shaped to fit onto said forward end of said receiver and said breech plug comprises said external threads.

* * * * *